US005630362A

United States Patent [19]

Jönsson

[11] Patent Number: 5,630,362

[45] Date of Patent: May 20, 1997

[54] REFUSE COMPACTOR WITH DEWATERING CAPABILITY

[75] Inventor: Rolf Jönsson, Stenungsund, Sweden

[73] Assignee: Roto-Sieve AB, Kungalv, Sweden

[21] Appl. No.: 428,125

[22] PCT Filed: Aug. 30, 1993

[86] PCT No.: PCT/SE93/00710

§ 371 Date: Apr. 25, 1995

§ 102(e) Date: Apr. 25, 1995

[87] PCT Pub. No.: WO94/09978

PCT Pub. Date: May 11, 1994

[30] Foreign Application Priority Data

Nov. 4, 1992 [SE] Sweden ..... 9203259

[51] Int. Cl.[6] ..... B30B 9/04; B30B 1/18

[52] U.S. Cl. ..... 100/52; 100/126; 100/191; 100/289

[58] Field of Search ..... 100/51, 52, 98 R, 100/125–127, 179, 191, 256, 289

[56] References Cited

U.S. PATENT DOCUMENTS

| | | | |
|---|---|---|---|
| 3,204,550 | 9/1965 | Swiderski et al. | 100/52 |
| 3,384,007 | 5/1968 | Boje et al. | 100/98 R |
| 3,604,345 | 9/1971 | Boje | 100/179 |
| 3,625,139 | 12/1971 | Gollnick | 100/52 |
| 3,643,589 | 2/1972 | Carter | 100/52 |
| 3,791,289 | 2/1974 | Lamorte et al. | 100/179 |

FOREIGN PATENT DOCUMENTS

| | | | |
|---|---|---|---|
| 508910 | 10/1920 | France | 100/191 |
| 604679 | 5/1926 | France . | |
| 493335 | 3/1930 | Germany . | |
| 2459411 | 4/1976 | Germany . | |
| 3-268896 | 11/1991 | Japan | 100/126 |
| 143398 | 10/1980 | Norway . | |
| 433522 | 5/1984 | Sweden . | |

OTHER PUBLICATIONS

Patent Abstracts of Japan, vol. 12, No. 262 (M–721), Japanese Application No. 62–99150, dated 2/1988.

*Primary Examiner*—Stephen F. Gerrity
*Attorney, Agent, or Firm*—Dvorak & Traub

[57] ABSTRACT

A refuse compacting device has dewatering capability and in some cases refuse transporting capability wherein refuse is fed into an outer cylinder in which an axially elongate piston is arranged. The piston is capable of reciprocating motion by a drive motor and threadable piston rod and nut arrangement, whereby refuse is forced towards an outlet of the cylinder. The cylinder is provided with apertures for allowing water to escape from the wet refuse as it is compacted against a conically shaped throttling member at the outlet of the cylinder.

9 Claims, 5 Drawing Sheets

REFUSE COMPACTOR WITH DEWATERING CAPABILITY

TECHNICAL FIELD

The subject invention concerns a device designed to dewater, compact, and in some cases transport refuse or similar waste material having comparatively high water contents, wherein the refuse is advanced via an inlet opening down into a cylinder in the interior of which an axially elongate piston is arranged so as to be displaced therein in a reciprocating movement by drive means, whereby the refuse is forced towards the cylinder outlet, said cylinder being provided with apertures to escape of water, particularly as the refuse is being compacted.

BACKGROUND OF THE INVENTION

Sewage water admitted to municipal sewage treatment plants contains large quantities of refuse and similar waste material. The refuse and similar waste material is separated in a first dewatering step by means of a screen, whereby the dry matter contents are increased to about 9%. The refuse leaving the screen thus is moist. However, it is desirable to increase the dry matter contents further in order thereafter to normally carry the refuse away. One common manner of doing so is to make use of a device known as a piston press by means of which the dry matter contents may be increased to nearly 20%. The Swedish Patent Application 383 315 discloses a piston press of this kind This piston press consists a cylinder of considerable longitudinal dimensions, arranged in such a position that it inclines upwardly towards the outlet. A reciprocating piston is arranged in the cylinder interior and a funnel feeds refuse down into the cylinder. The piston pushes the refuse, disposed in front of the piston, towards the cylinder outlet. This piston press is characterized therein that it is shaped as an elongate pipe mounted with an inclination with respect to the horizontal plane and with its lowermost end, formed with drainage holes, positioned below the funnel, in that the stroke of the piston exceeds the length of the feed-in opening, and in that the pipe length, calculated from the feed-in opening, equals at least twice the length of the stroke. Owing to the considerable length beyond the maximum extension of the piston a braking effect acting on the refuse is created. This braking effect contributes to compacting and dewatering of the refuse. The water is drained from the waste towards the drainage apertures, owing to the inclination of the cylinder. From the piston press outlet the compacted refuse falls into a bag or similar container.

However, this piston press has certain drawbacks. The braking effect on the refuse is generated in consequence of the length of the piston press, which results in a machine of considerable longitudinal dimensions. In addition, it needs to have an upwards slope in order to function satisfactorily and in some cases this could be disadvantageous. The piston is actuated by a hydraulic cylinder by means of a hydraulic unit. This is a complex and expensive solution since it requires a multitude of components, among them an oil tank, a driving motor, pumps, and lines. Consequently, the hydraulic unit becomes comparatively bulky while at the same time it involves a definite risk for oil spillage. In addition, it is a complex operation to change the length of the stroke of the hydraulic cylinder in a hydraulic system of this kind. To be able to modify the stroke of the cylinder rapidly is often desirable in order to allow testing of changed operational parameters. Hydraulic systems do not lend themselves to such adaption in a rapid and efficient manner. Essentially, the complexity entails problems and consequential dangers of errors, high costs and limited flexibility with respect to stroke length adjustment.

SUMMARY OF THE INVENTION

The essential purpose of the invention is to reduce the above problems by means of a piston press having a simplifed construction and allowing convenient re-setting of the operational parameters.

The device in accordance with the invention is essentially characterized in that at least one refuse braking means, e.g. in the form of a conical throttling member or a throttling valve or a conveyance line, or a combination of these means, is connected to the cylinder outlet, in that the piston drive means comprises a first threaded member, such as a threaded rod, and at least one second threaded member, such as a nut member carried on said first member, the threads of said members interacting and in that the first threaded member interconnects the cylinder and the piston and the drive unit drives either one of the threaded members alternatingly in the clockwise and the anti-clockwise direction, imparting to the piston a reciprocating motion inside the cylinder. In this case, the piston drive thus is achieved by cooperation between a threaded member, such as a threaded rod, and a nut member. As these means rotate that create a force advancing the piston axially. Rotation in the opposite direction results in advancement of the piston in the opposite direction. Piston drive in accordance with this basic concept makes considerable simplification possible compared with the hydraulic actuation means used hitherto. By incorporating a short refuse-braking means, e.g. in the shape of a conical throttling member or a throttling valve the overall length of the piston press may be reduced. This is true in all cases when it is not connected to a conveyance line. In cases when the piston press is connected to a conveyance line, the use of e.g. a conical throttling member could in many cases result in a shorter overall installation.

The connection of respectively the piston and the cylinder with the threaded member, such as a threaded rod, could be effected in several different ways. For one of the components, the connection is effected by means of a nut member which is rotationally or non-rotationally mounted on the component. In cases when The connection is effected by means of a non-rotational nut the connection to the second component could be effected either by means of a bearing or by means of a nut. In accordance with one preferred embodiment the bearing is positioned inside the cylinder, attached to the end thereof. The non-rotational nut is attached to the neighbouring end wall of the piston. A driving unit positioned adjacent the bearing turns the threaded rod in the clockwise or the anti-clockwise direction. As a result a piston advancement motion is created and the threaded rod is projected into or is retracted from the piston interior. In accordance with this solution, the piston is provided with an interior pipe which together with the two end walls and the nut member delimits a closed space which is filled with a suitable quantity of lubricant, such as grease. This ensures satisfactory lubrication of the threaded rod. In this case it is likewise possible to place the driving unit inside the piston and attach it to the threaded red. This arrangement necessitates on the one hand a different solution of the lubrication problem and on the other some form of torque-absorbing means between the driving unit and the piston interior so as to prevent the driving unit from rotating while allowing it to simultaneously move in the axial direction. It is of course also possible to position the bearing in the piston end wall and the non-rotational nut at the end of the cylinder, which quite simply involves a reversion of the earlier varieties. The drive of the threaded rod could then be effected either by means of a driving unit inside the piston, which unit is axially stationary but obviously must possess torque absorption with respect to the piston. Alternatively, it is of course possible to sesure the driving unit to the outer end of the threaded rod in such a manner that it will travel together with the latter, away from the cylinder and bask towards the latter. A condition for this arrangement is that moment absorption means are provided between the driving unit and the cylinder or the floor underneath. In addition, this means is to allow axial movement of the driving unit.

Also the second component may be connected to the threaded rod with the aid of a non-rotationally mounted nut in this case the threaded rod should be provided with threads extending in two different directions, left-hand threads and right-hand threads, departing approximately from its centre and outwards towards the ends. In addition the two nuts also should be formed with left-hand and right-hand threads. Driving motion is imparted by the driving unit acting on one of the ends of the threaded rod, i.e. either the inner end in the piston interior, having torque-absorbing means as previously indicated, or the outer end exteriorly of the machine. Like before, the driving unit is in this case attached to the threaded rod and travels together with the latter and it is provided with a torque-absorbing means.

One advantage achieved with the solutions involving two nuts is that it makes long stroke lengths possible because the threaded rod on the one hand projects into the piston as it is being retracted and one the other extends exteriorly of the cylinder.

It is likewise possible to provide one of the components with a rotational nut member. The latter is then supported in the component, i.e. either the piston or the cylinder, and it has a driving means attached to it. The latter is typically formed with teeth in engagement with the nut member the teeth being either external or internal. In this case the driving unit advances the nut member as a result of an associated cog wheel cooperating with the nut member rack. One example of a solution of this kind is when one of the components is formed with one rotationally driven nut of the kind indicated whereas the other component is formed with a stationary nut. Like before, the threaded rod has right-hand threads as well as left-hand threads and the nuts are oppositely threaded. In the same manner as before the solution allows very long stroke lengths. The rotational nut, which is driven too, thus could be placed either in the cylinder end wall or in the piston end wall. Consequently, the driving unit is either positioned at the end of the cylinder or in the piston interior.

According to yet another modification the threaded rod is non-rotationally secured in one of the components and is connected with the other one with the aid of a rotatable nut the latter likewise being driven. For instance. The threaded rod may be attached to the piston end wall and a rotatable nut may be mounted at the end of the cylinder. In this case the driving unit advances the nut member with the aid of teeth formed on the latter, in the same manner as before. Upon retraction of the piston the threaded rod therefore will extend an increasingly longer distance beyond the cylinder end. It should then be enclosed in a cylindrical housing containing grease for lubrication of the nut. Reversely, the threaded rod may be non-rotationally secured to the cylinder end and instead the rotable nut be secured in the piston end wall. In this case, the driving unit preferably is positioned inside the piston and is secured thereto This arrangement allows a very short overall solution.

BRIEF DESCRIPTION OF THE DRAWINGS

The invention will be described in closer detail in the following with reference to the accompanying drawing figures, wherein identical numeral references have been used in the various figures to designate corresponding details, and wherein.

DETAILED DESCRIPTION OF PREFERRED EMBODIMENTS

Figure 1:
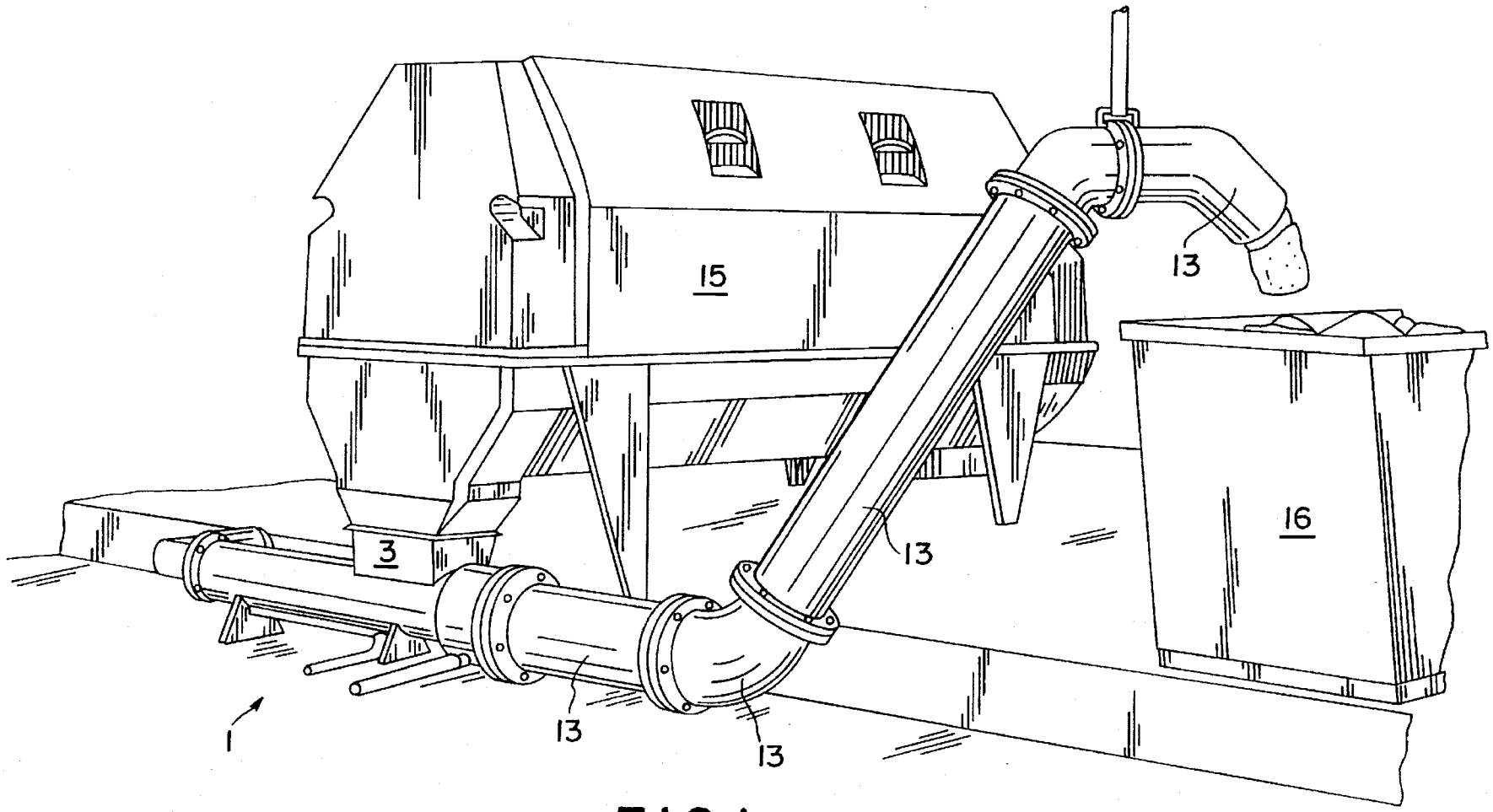
FIG. 1 is a perspective view of a plant wherein a sieve advances refuse to a piston press in accordance with the invention, which conveys the refuse further to a container.

FIG. 1 illustrates a piston press intended for dewatering and compacting of refuse and similar waste material. In the version illustrated it conveys the refuse via a conveyance pipe 13 to a container 16. The refuse is fed into the piston press via the press inlet opening or funnel 3. The material to be dawatered in the piston press could be of various different types, such as the waste from a municipal sewage treatment plant or from a fish-gutting plant. However, the material could also be pulp to be dewatered. The version illustrated in this drawing figure is typical for use in a municipal sewage treatment plant. Water containing refuse is admitted to a sieve 15 in which the dry matter contents are increased to about 8 to 9%. From the sieve 15, the refuse is admitted into the piston press 1 via the funnel 3, which increases the dry matter contents to about 20%. With the aid of a pipe line 13 it also conveys the refuse to the container 16. A considerable advantage offered by the piston press is precisely its ability to serve not only as a dewatering device but also as a transportation means. In the version illustrated it thus is capable of forcing the material upwards so as to allow it to be emptied into a container. The advancement is effected with the aid of the very piston that is designed to effect the dewatering function as such. In addition, the conveyance is carried out in a closed pipe line system 13. This is an advantage, since the refuse often consists of bad smelling feces which begin to rot upon contact with air.

Figure 2A:
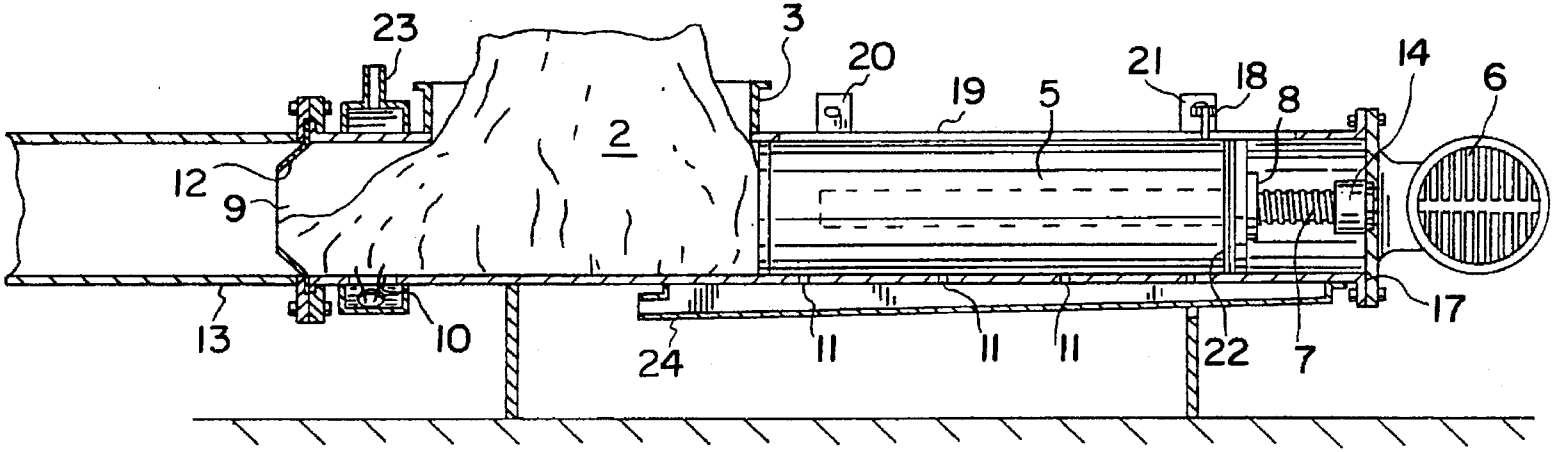
FIG. 2*a* is a cross-sectional view through the piston press in accordance with the invention with the piston assuming its retracted position.
Figure 2B:
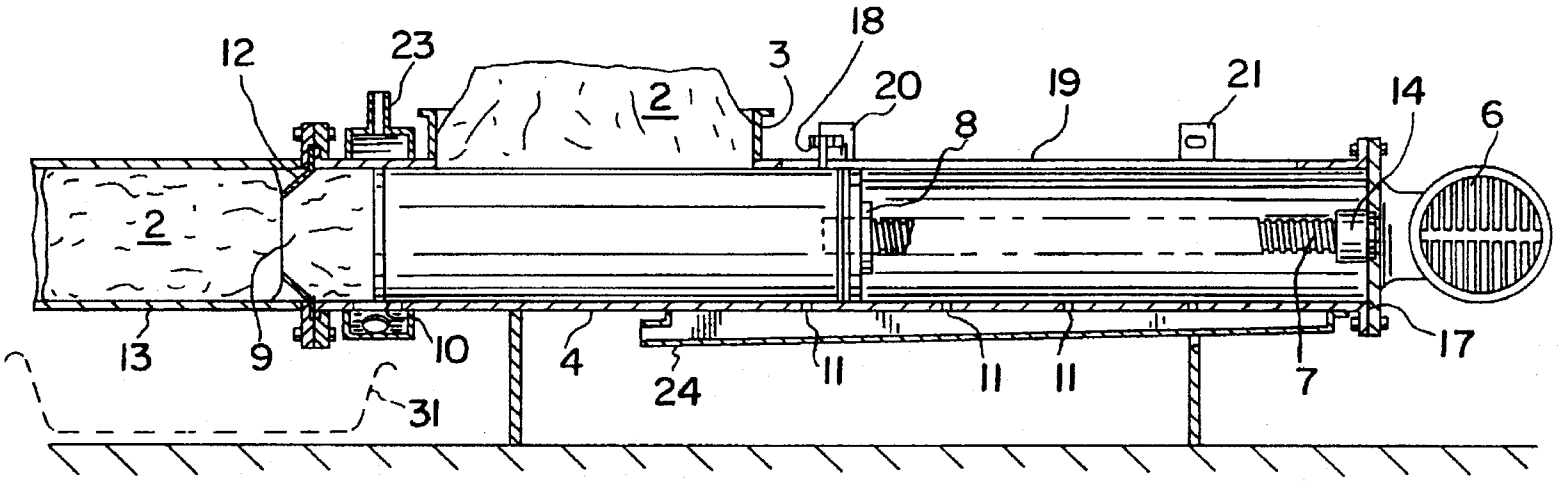
FIG. 2*b* illustrates the piston press of FIG. 2*a* but with the piston assuming its extended position.

FIGS. 2*a* and 2*b* illustrate the mode of operation of the piston press in accordance with the invention. The piston press essentially consists of a cylinder 4 which is provided with an inlet funnel 3 for feed-in of refuse 2 or similar waste material. At one end of the cylinder an axially movable piston 5 is provided, the motions of said piston being effected by means of a driving device 6–8, 14. Dewatering apertures 10, 11 are formed in the cylinder to allow drainage of the liquid from the refuse. The main and normal drainage Takes place through the apertures 10 whereas the apertures 11 could be regarded mainly as emergency drainage apertures. The piston movement is effected by means of a threaded rod 7 which cooperates with a nut 8, the latter being secured to the right-hand end wall of the piston 5. A bearing 14 supports the threaded rod 7 in an end plate 17 which is secured to the end of the cylinder 4. Thus, the threaded rod 7 is allowed to rotate in its supporting bearing 14 but it is axially immobile with respect to the latter. A driving motor 6 turns the threaded rod 7. This means that when the threaded rod is turning in one direction the piston is advanced in the direction towards the cylinder outlet 9, forcing the refuse in the direction towards the cylinder outlet 9. A throttling conical member 12 is positioned adjacent the outlet. During this piston movement liquid will be drained from the refuse and the latter will be compacted. FIG. 2*b* illustrates e position when the piston 5 has reached its end position adjacent the cylinder outlet 9. It should be noted that normally the piston only partially covers the apertures 10. In this position the piston is immobile while water is being drained through the apertures 10. However, it is also possible for the piston to cover the apertures 10. This is the case particularly when it is desired that the stroke be extra long and this possibility therefore is made use of. The driving unit 6 is then started for rotation in the opposite direction, whereby the piston will be retracted and return to the position illustrated in FIG. 2*a*, wherein it is stopped.

According to the embodiment illustrated in these drawing figures the conical throttling member 12 impedes the movement of the refuse very considerably. A condition for extensive draining is precisely heavy throttling and braking of the refuse movement. Essentially, such throttling or braking effect may be achieved solely by means of the conical throttling member 12. This member could, of course, also be configured to exert an even heavier throttling force than that effected by the embodiment illustrated. This allows the refuse to be removed immediately upon leaving he piston press 1, should this be considered desirable. This possibility is suggested in drawing FIG. 2*b* by means of a storage container 31, illustrated in broken lines. Instead of the conical throttling member 12 it is possible to use a spring-operated baffle. The spring force ensures that sufficient braking force is exerted on the refuse 2 to allow dewatering of the latter to the desired degree.

But as a rule, it is desirable to convey the refuse further in a conveyance pipe 13. According to the version of FIG. 1 the refuse is fed to a container 16 positioned at a higher level. One advantage of the conical throttling member 12 is that it prevents the refuse 2 from sliding rearwards into the piston press when the piston is retracted to the position illustrated in FIG. 2*a*. However, also the transportation of the refuse in the pipe 13 generates a braking force. The latter increases with increasing pipe lengths and transportation upwards of the refuse and increases heavily in pipe bends. In other words, the braking effects from respectively the conveyance pipe 13 and the throttling member 12 or similar means are added. In some cases the braking effect is very close to the upper limit of the operational capacity of the piston press, as a result of the transportation need. It may then be desirable, and in some cases possible, to eliminate the conical throttling member 12.

The driving unit 6 is actuated by means of limit switches 20, 21 which are positioned externally of the cylinder 4. They are simply displaceable in the axial direction of the cylinder. The piston 5 is provided with a radially projecting actuating member 18 which travels in an axial groove 19 in The cylinder 4. From the position illustrated in FIG. 2*a* the driving unit 6 is started for movement in the rotational direction that causes the piston to advance towards the cylinder outlet 9. When the actuating member 18 reaches the limit position 20 it reverses a switch, thus causing the drive to cease. Consequently, the piston is at a standstill in the position illustrated in FIG. 2*b* and continued dewatering takes place, predominantly through apertures 10, until the piston returns to its position of rest. After a predetermined period the driving unit is re-started for movement in the opposite rotational direction, whereby the piston is retracted from the cylinder outlet 9. When the actuating member 18 hits the limit switch 21, the current is interrupted in consequence, the piston stops in the position illustrated in FIG. 2*a*. After a predetermined period, the sequence is re-started. The dwelling times could of course be varied in a very simple manner. In addition, the dwelling time in the position of FIG. 2*a* could of course be governed by the influx of refuse or the like. In addition, the limit switches 20, 21 are very simple to move axially and thus the end positions easily could be changed and in consequence thereof also the length of the stroke of the piston 5. The result is considerable flexibility and simplicity in the setting of The operational parameters. This is an obvious advantage compared with the hydraulic operation use in conventional piston presses. As appears from FIGS. 2*a*, 2*b*, the piston 5 is provided with a circular seal 22, for example in the shape of an O-ring in addition, the cylinder 4 normally is provided with a peripheral seal which is positioned in constant contact with the piston. This means that it will be positioned immediately to the left of the left end of the groove 19 in the wall of the cylinder 4.

Figure 3:
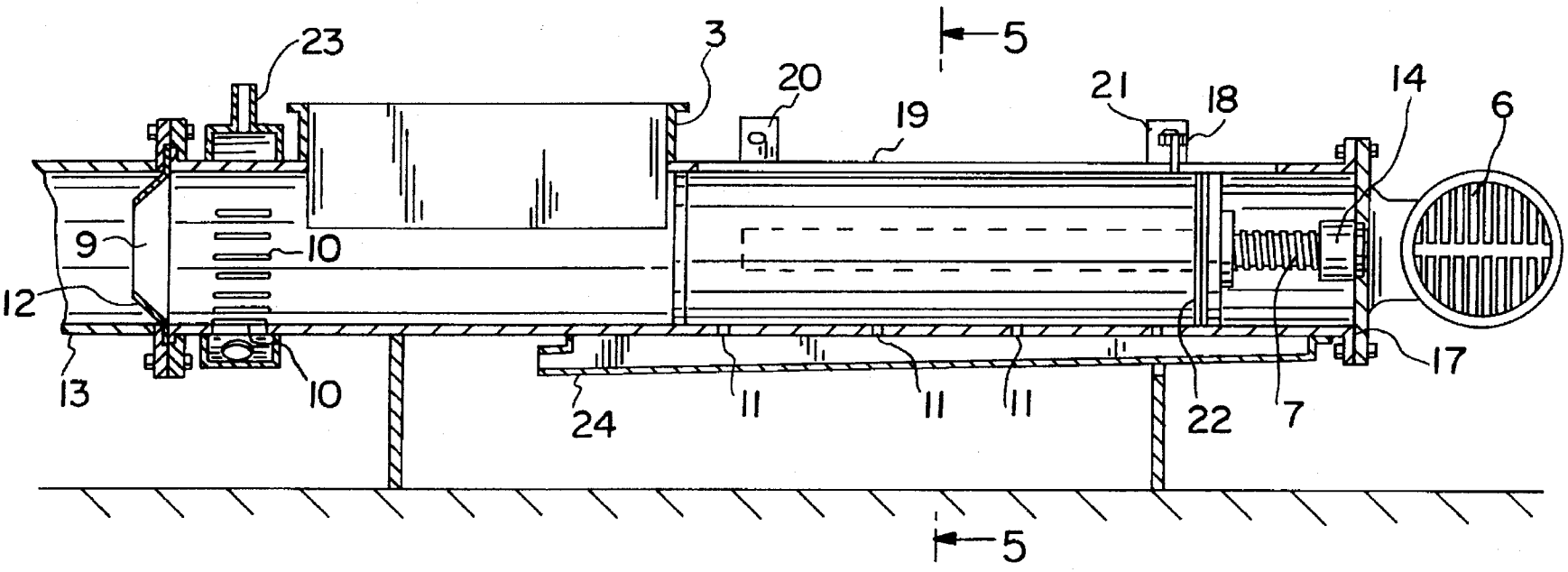
FIG. 3 is a detail view of the configuration and arrangement of the dewatering apertures of the piston press.

FIG. 3 illustrates more clearly the arrangement and configuration of the apertures 10. As shown, they are in the shape of elongate slits spaced around a large part of the cylinder periphery. They dabouch into a void extending around the periphery and from this void drainage pipes extend in the conventional manner. The void also has a fitting 23 for attachment of a flushing line or flushing hose for admittance of water to flush the slits clean. The drainage apertures 11 are positioned underneath the piston 5 when the latter is in its retracted position. The apertures 11 debouch into a collection box 24 which is connected to an external drainage line. Liquid penetrating into the space between the piston and the cylinder thus is drained this way.

Figure 4:
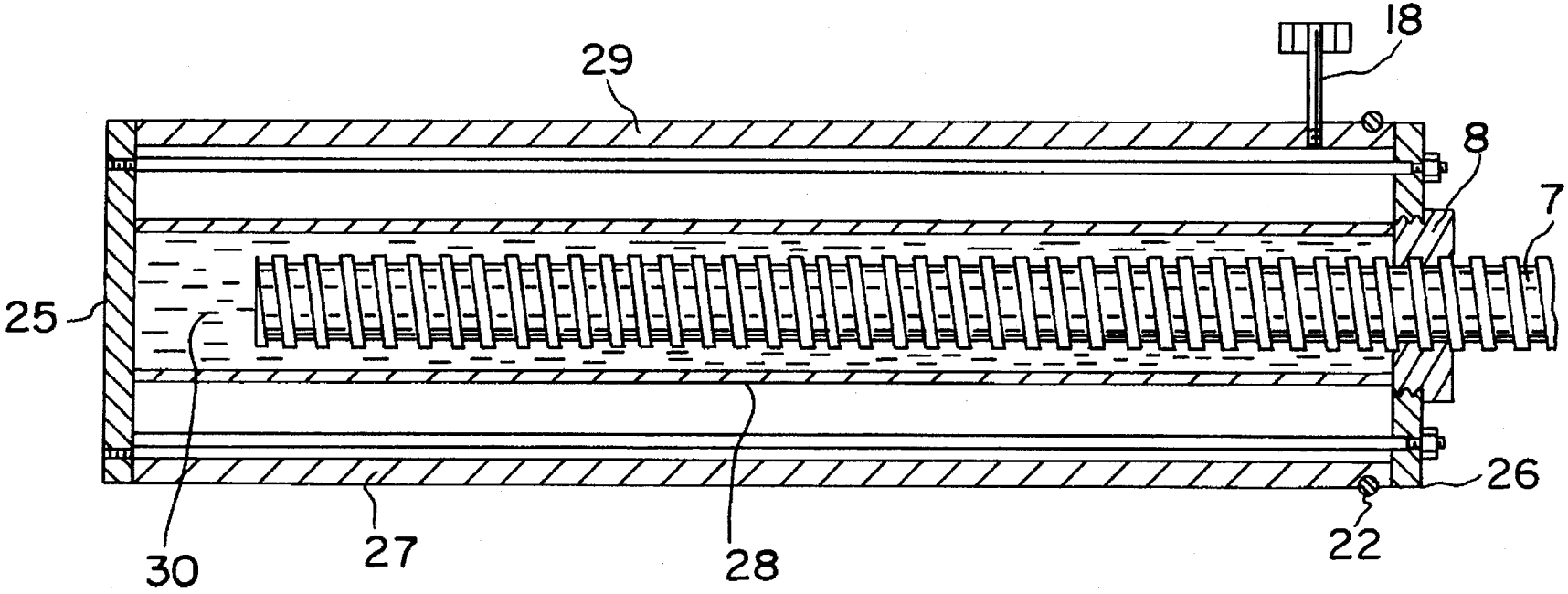
FIG. 4 is a cross-sectional view showing the construction of the piston of the piston press.

FIG. 4 illustrates the construction of the piston 5. It has a front end wall 25, as seen in the piston pressing direction, and a rear end wall 26 which faces the driving unit 6. The two end walls 25, 26 are interconnected by e cylindrical jacket 27 and an inner pipe 28 as well as by means of a number of connecting rods 29. The jacket 27 is as a rule made from a suitable quality plastics material, which ensures low friction and no wear on the cylinder 4. The plastics jacket could also have a certain yieldable quality in order to accommodate hard substances that may find their way into the space between the piston and the cylinder. The nut 8 is attached to the rear end wall for instance by means of the screw joint shown in the figure. Obviously, it could be attached in several other ways. The inner pipe 28 is supported on the nut 8 at one of its ends while the opposite pipe end is supported on the front end wall 25. This means that pressure from the front end wall 25 normally is transferred directly to the nut 8. The threads of the threaded rod 7 usually have a trapezoidal cross-sectional shape but obviously other thread configurations are possible. A closed space is formed between the nut 8 with the threaded rod 7 and the front end wall and the inner pipe 28. This space is filled with a carefully adjusted amount of grease 30 for lubrication of the threaded rod 7. Because of this excellent lubrication low friction losses between the threaded rod 7 and the nut 8 are ensured. The actuating member 18 is secured to the jacket 27, for instance by means of screws. However, the actuating member 18 could equally well have been attached to the rear end wall 26.

Figure 5:
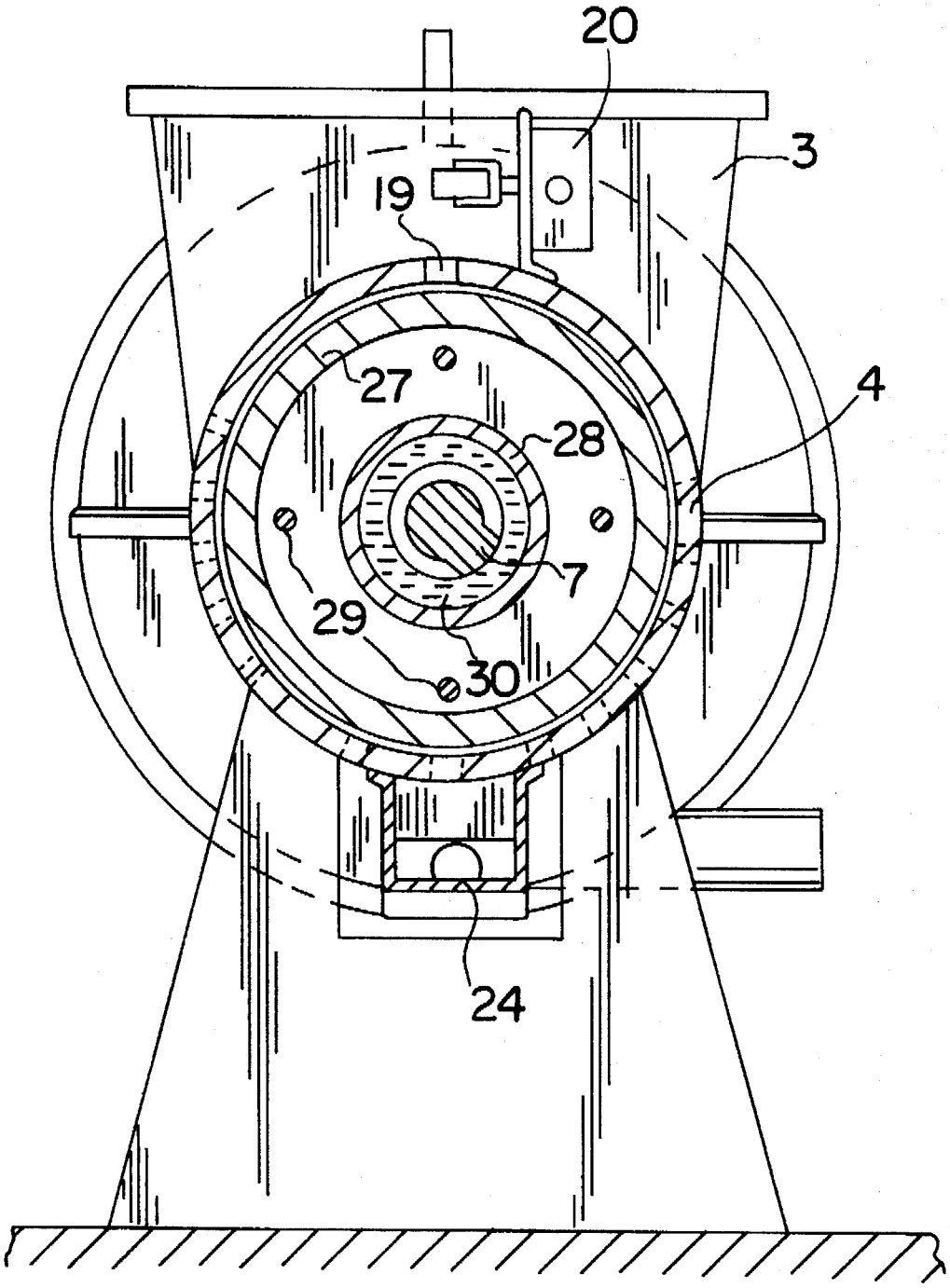
FIG. 5 is a cross-sectional view along line 5—5 of FIG. 3, illustrating the piston press in the axial direction thereof.

FIG. 5 is a cross-sectional view along line 5—5 of FIG. 3. This drawing figure illustrates how the funnel is joined to the cylinder 4, and how the limit switch 20 is placed on the cylinder. From the drawing figure also appears the embedment of the threaded rod 7 in grease 30 in the interior of the inner pipe 28.

A number of modifications are possible within the scope of the invention. This is true particularly as concerns the driving system. The preferred embodiment illustrated is characterized by the mounting of the threaded rod 7 in a bearing 14 which is attached to the cylinder end 4, and the driving unit 6 actuates the outer end of the threaded rod 7. The nut is attached to the rear end wall 26 of the piston 5 the reverse arrangement is equally possible, i.e. to secure the bearing to the rear end wall 26 of the piston 5 and the nut 8 to the cylinder 4. In this case the driving unit could either be positioned inside the piston 5 or be attached to the outer end of the threaded rod 7 in the latter case, the driving motor thus travels outwards together with the outer end of the threaded rod. A torque-absorbing stay capable of absorbing this axial movement is in this case secured between the driving unit 6 and the cylinder 4. In addition, it is possible to arrange the nut 8 in such a manner that it is rotationally mounted either in the rear end wall 26 or in the end plate 17, the latter being secured to the cylinder 4 in this manner the driving unit thus is capable of turning the nut and no bearing 14 is required instead, the threaded rod 7 is non-rotationally secured to either the piston 5 or the end plate 19. The driving unit 6 may then be positioned either at the rear end of the cylinder 4 or it could be positioned in the piston interior. In addition, it is possible to provide the threaded rod with two nuts, one of which is secured to the rear end wall 26 and The other one to the end of the cylinder 4. In this case the threaded rod 7 comprises two, oppositely threaded pares. Also the two nuts are in this case oppositely threaded, one having right-hand threads and the other left-hand threads. The driving unit 6 is than normally connected to the outer end of the threaded rod 7 and follows in the axial movement thereof. This is made possible by means of an articulated torque-absorbing stay or similar means. It is likewise possible to place the driving unit inside the piston 5 while using an articulated torque-absorbing stay which is secured to the interior wall of the cylinder. This solution allows long stroke lengths compared with the proper length of the piston 5, particularly if the driving unit is not placed inside the piston but externally. This is so because the threaded rod 7 will both project into the piston and extend out of the cylinder upon retraction of the piston. The driving system including a threaded rod 7 and a nut 8 thus could ba varied in a many different ways.

What is claimed is:

1. A refuse compaction device for compacting and dewatering wet refuse material comprising:

an outer and open cylinder having a longitudinal axis and defined by an outside and inside surface and a pair of ends, one of said ends having an end plate secured thereto and the other of said ends including a conically shaped refuse throttling member attached thereto and defining a cylinder outlet, said cylinder including a radially disposed refuse inlet tunnel near said outlet end for feeding refuse into said outer cylinder and a plurality of axially arranged apertures generally oriented between said refuse inlet and said cylinder outlet, said apertures extending at least hemicircularly about said cylinder for allowing water to be drained from said outer cylinder;

an axially elongate piston disposed concentrically within said outer cylinder and axially operable in a reciprocating fashion towards and away from said cylinder outlet so as to compact said refuse and displace water therefrom, said piston comprised of an open cylindrical jacket having a front end and a rear end, each of said ends closed by a respective front end wall and rear end wall, said rear end wall including a centrally located throughbore;

means for driving said piston, said means comprised of a drive motor for rotationally turning a threaded rod within a threaded nut, said nut secured to said rear end wall of said piston and centered about said throughbore, said threaded rod having an inner end that interacts with said nut and an outer end that is connected to said motor and supported by a bearing, said bearing and said motor attached to said end plate of said outer cylinder, said threaded rod extending into said open cylinder of said piston, thereby connecting said piston with said outer open cylinder such that clockwise and counterclockwise rotation of said rod within said nut axially displaces said piston towards and away from said cylinder outlet, said piston formed with an inner pipe secured to and extending between each of said piston end walls such that said inner pipe, with said end walls and said nut, delimits a closed space, said closed space filled with an amount of lubricant adjusted to said threaded rod and said nut, wherein displacement towards said outlet compacts said refuse between said conical throttling member and said piston, when said piston is in a fully axially displaced position, whereby water is drained from said refuse into said plurality of apertures in said open cylinder and out of said device.

2. The device as claimed in claim 1, wherein said end plate and the bearing are integrally formed with the drive unit.

3. The device as claimed in claim 1, wherein the amount of lubricant within said closed space reduces friction between the threaded rod and the nut.

4. The device as claimed in claim 1, wherein said inner pipe is made of a material having a thickness, the thickness of the material simultaneously serving as a means for axial reinforcement of the piston by supporting the axial forces acting between the front end wall of the piston and the nut.

5. The device as claimed in claim 1, wherein the outer cylinder is provided with at least two limit switches, axially displaced from each other and each of which is activated by contact with said piston at a corresponding axial position of the piston and wherein said switches are axially repositionable in order to alter a stroke length of the piston, said stroke length corresponding to the axial displacement between said limit switches.

6. The device as claimed in claim 5, wherein the outer cylinder is formed with a longitudinal slit and wherein an actuating member is secured to the cylindrical jacket of the piston, said actuating member being displaceable within said longitudinal slit and responsible for activating the limit switches upon contact therewith.

7. The device as claimed in claim 1, wherein the piston cylindrical jacket, the end walls, and the connecting rods are integrally joined, thereby contributing to a reinforcement of the jacket.

8. The device as claimed in claim 1, wherein the piston cylindrical jacket is made from a plastic material.

9. The refuse compaction device of claim 1, wherein an extent of axial displacement of said piston and a period of time said piston is held at a fully extended position is controlled by said limit switches, said extent of piston displacement and said period of time at said extent corresponding to a degree of compaction and drainage of said refuse.

* * * * *